United States Patent [19]

Matsumoto

[11] Patent Number: 4,779,551

[45] Date of Patent: Oct. 25, 1988

[54] VESSEL HAVING LATERALLY OFFSET PROPELLER

[75] Inventor: Norihiro Matsumoto, Tokyo, Japan

[73] Assignee: Nippon Kokan Kabushiki Kaisha, Tokyo, Japan

[21] Appl. No.: 65,334

[22] Filed: Jun. 22, 1987

[30] Foreign Application Priority Data

Jul. 30, 1986 [JP] Japan ..... 61-177844

[51] Int. Cl.[4] ..... B63B 1/08

[52] U.S. Cl. ..... 114/57; 440/79

[58] Field of Search ..... 440/49, 66, 67, 68, 440/75, 79-83; 114/56, 57

[56] References Cited

U.S. PATENT DOCUMENTS

| | | | |
|---|---|---|---|
| 2,162,058 | 6/1939 | Brush | 440/79 |
| 3,014,449 | 12/1961 | Nitzki et al. | 114/57 |
| 3,996,877 | 12/1976 | Schneekluth | 440/79 |
| 4,363,630 | 12/1982 | Di Vigano | 114/57 |
| 4,538,537 | 9/1985 | Nonnecke | 114/57 |

FOREIGN PATENT DOCUMENTS 2320859 11/1977 France .

OTHER PUBLICATIONS

Ocean Engineering, vol. 10, No. 4, pp. 213-226, 1983 Fuel Saving by Asymmetric Afterbodies for Single-Screw Vessels.

*Primary Examiner*—Joseph F. Peters, Jr.
*Assistant Examiner*—Jesûs D. Sotelo
*Attorney, Agent, or Firm*—Frishauf, Holtz, Goodman & Woodward

[57] ABSTRACT

A vessel equipped with a single screw, comprising a hull which is symmetrical with regard to a vertical center plane containing the center line of the hull, and a propeller shaft which is positioned laterally offset from the vertical center plane of the hull. The propeller shaft is positioned such that a ratio (d/D) is from 5 to 25%, where d represents a distance between the propeller shaft and the vertical center plane of the hull, and D represents the diameter of the propeller.

8 Claims, 3 Drawing Sheets

VESSEL HAVING LATERALLY OFFSET PROPELLER

BACKGROUND OF THE INVENTION

1. Field of the Invention

The present invention relates to a hull form of a vessel, and more particularly to a position where a propeller shaft is installed.

2. Description of the Related Art

A body plan of a single-screw hull equipped with a conventional symmetric type stern is shown in FIG. 1, wherein reference numeral 1 denotes a transverse sectional shape, 2 denotes the hull center line, 3 denotes a propeller shaft, 4 denotes a propeller disc plane and WL denotes a load waterline. It is well known that the propeller shaft is usually provided on the vertical central plane of the hull, for a conventional type of a single-screw vessel.

When the propeller shaft is installed in such a position, water inflows to the propeller disc plane are shown in FIGS. 2(A) and 2(B). FIGS. 2(A) and 2(B) represent graphically water inflow speed to the propeller disc plane. FIG. 2(A) is a representation of wake distribution, and FIG. 2(B) is a vector diagram for transverse velocity of water. Curved line (a) shows a ratio of wake speed generated on the propeller disc plane in relation to vessel speed, and vector (b) shows the transverse direction of wake velocity generated on every point of the propeller disc plane. As clearly understood from these representations, inflows to the propeller disc plane are formed into symmetrical flows with regard to propeller shaft 3. In this manner, complicated distribution of wakes are generated while the vessel is sailing. As shown in FIG. 3, the wakes become symmetrical with regard to propeller shaft 3 positioned on the vertical center plane 2 of the hull.

Vessels with high block coefficient and wide breadth have been increasing in number to raise loading capacity. Owing to this high blockage coefficient and wide breadth, vertical vortices around longitudinal axes are generated on the propeller disc plane, from the aforementioned wakes. These vertical vortices are generated in pairs by both sides of a vessel, unbalancing the wakes on the propeller disc plane. This results in reducing efficiency in propulsion and increasing hull-resistance. In those circumstances, there has been demanded a reduction of the ratio of fuel consumption for sailing as well as improvement in loading capacity. To satisfy this demand, improvement in propulsive efficiency is indispensable.

SUMMARY OF THE INVENTION

It is an object of the present invention to provide a vessel having high propulsive efficiency.

In accordance with the present invention, there is provided a vessel comprising:

a hull which is approximately symmetrical with respect to a vertical center plane containing the center line of the hull a propeller shaft which is positioned laterally offset from the vertical center plane of the hull; and a propeller installed on the propeller shaft.

DESCRIPTION OF THE PREFERRED EMBODIMENT

Figure 1:
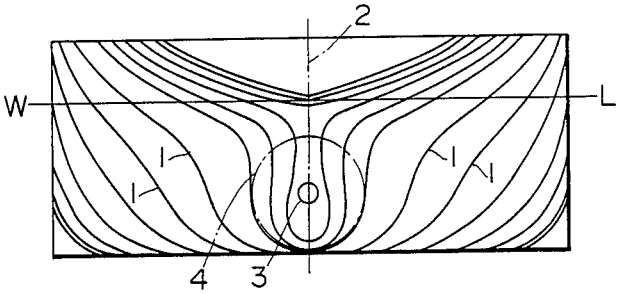
FIG. 1 (PRIOR ART)
FIG. 1 is a body plan showing an afterbody of a prior art vessel viewed from the back side.
Figure 2:
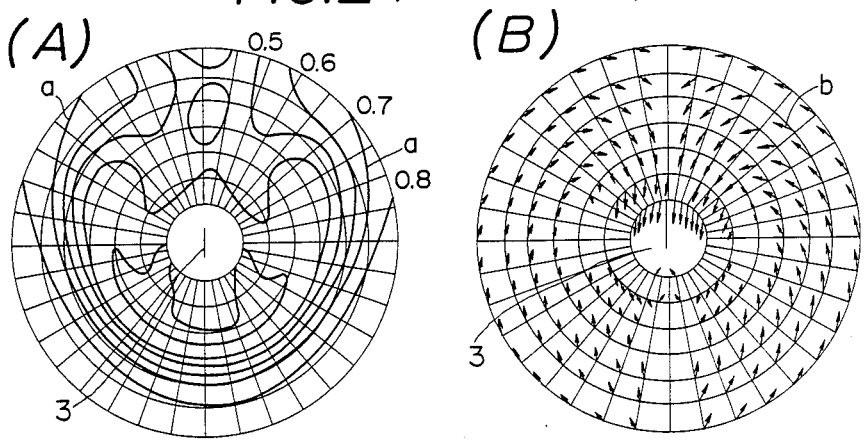
FIG. 2 (PRIOR ART)
FIGS. 2(A) and 2(B) are graphic representations showing water inflow speed to a propeller disc plane provided for a prior art vessel.
Figure 3:
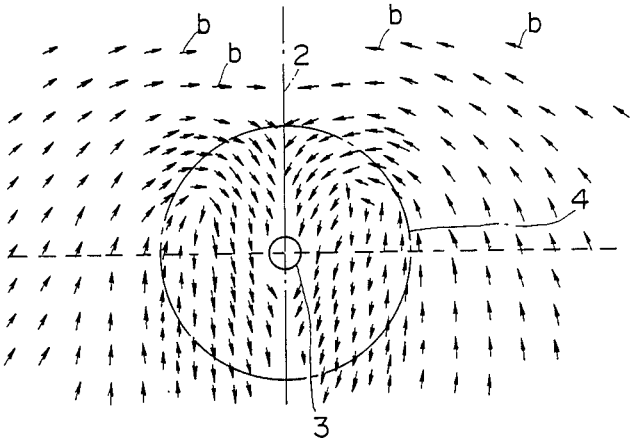
FIG. 3 (PRIOR ART)
FIG. 3 is a graphic representation showing a vector diagram of water inflows on the propeller disc plane provided for a prior art vessel.
Figure 4:
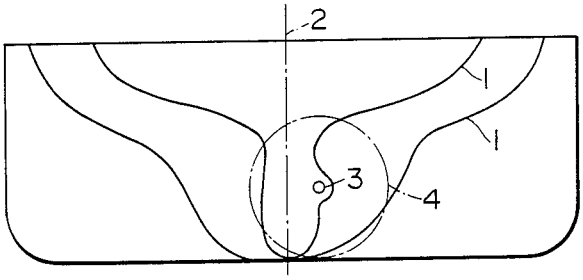
FIG. 4 is a body plan showing an afterbody of a vessel viewed from the back side, according to the present invention.

Referring now to the drawings, wherein like reference characters designate like parts or corresponding parts throughout the several views, FIG. 4 shows a plan view of an afterbody of a hull body plan of the present invention, as viewed from the back side. As shown in FIG. 4, the hull construction is symmetrical with regard to the vertical center plane 2 containing the center line of the hull (hereinafter referred to as the vertical center plane) and the propeller shaft is positioned laterally offset from the vertical hull center place 2. Consequently, the only parts at which the propeller shaft is installed are asymmetrical.

How the propeller shaft is positioned will now be described.

Figure 5:
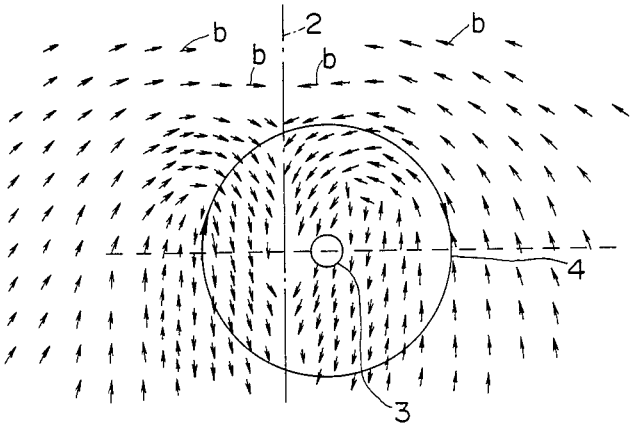
FIG. 5 is an elevational view showing a vector diagram of water inflows on the propeller disc plane, according to the present invention.

With reference specifically to the drawing, FIG. 5 represents vector diagram illustrating movements of water inflows on the propeller disc plane of a vessel. As shown in FIG. 5, water inflow vector b is the transverse component of velocity which is symmetrical about vertical hull center plane 2. Propeller blades are rotated clockwise, about the axis of propeller shaft 3 which is positioned horizontally on the starboard side of the hull center plane.

Figure 6:
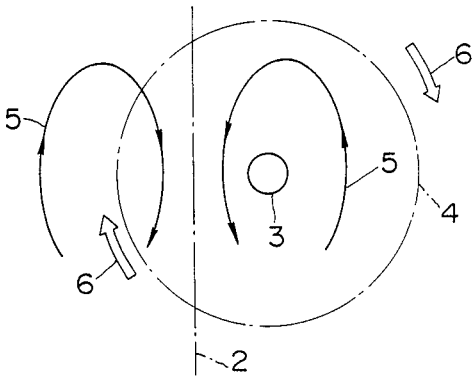
FIG. 6 is a schematic illustration showing the relationship between water inflows to a propeller disc plane and the rotating direction of the propeller according to the present invention.

The relationship of the direction of the water inflows to the direction of the rotation of the propeller is shown in FIG. 6. In FIG. 6, arrows 5 represent a direction of the water inflows which is indicated by vector b shown in FIG. 5. Arrow 6 represents a rotating direction of the propeller.

As seen from FIG. 6, the propeller constantly receives the water inflows that circulate reverse to the direction to which the propeller shaft is rotated. This gives such an effect as if the rotating speed of the propeller shaft were increased. In other words, an increase of propulsion efficiency can be attained by this positioning of the propeller shaft.

As described above, an increase of propulsion efficiency is attained by rotating the propeller shaft clockwise when the propeller shaft is positioned on the starboard side of the vertical hull center plane, and by rotating the propeller shaft counterclockwise when it is positioned on the port side. Otherwise, for example, when the propeller shaft is positioned on the starboard side and rotated counterclockwise, the rotating direction of the propeller shaft becomes the same as the circulating direction of water inflows. Consequently, the propulsion efficiency is lowered. When the propeller shaft is positioned on the port side and rotated clockwise, the propulsion efficiency is lowered as well.

Figure 7:
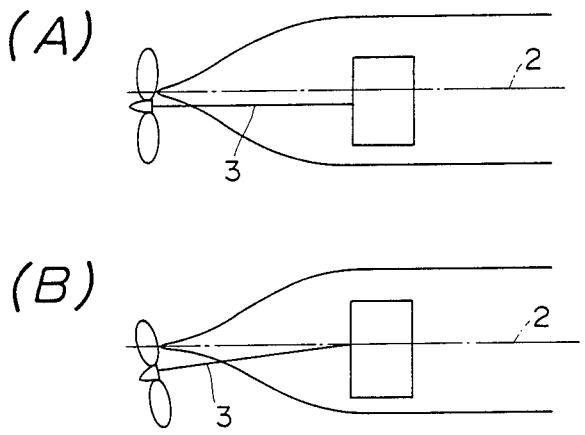
FIGS. 7(A) and 7(B) are schematic representations showing plan views of embodiments of the present invention.

With reference now specifically to the drawing,

FIGS. 7(A) and 7(B) show plan views of examples of the present invention. A rudder at the stern is positioned on the hull center plane. FIG. 7(A) is a schematic representation illustrating propeller shaft 3 being positioned horizontally in parallel to and offset from the vertical the hull center plane 2, without a horizontal rake. FIG. 7(B) is a schematic representation illustrating propeller shaft 3 arranged with a horizontal rake angle relative to the vertical hull center plane 2. The space of an engine room and the capacity of a main engine determined whether the arrangement of FIG. 7(A) or of 7(B) is adopted. According to test results, there was no difference between the types of FIGS. 7(A) and 7(B) with respect to steering ability and propulsion efficiency. In addition, there were no differences between one vessel equipped with a propeller shaft positioned laterally offset from the vertical hull center plane and another vessel equipped with a propeller shaft conventionally positioned, with respect to the steering ability.

Figure 8:
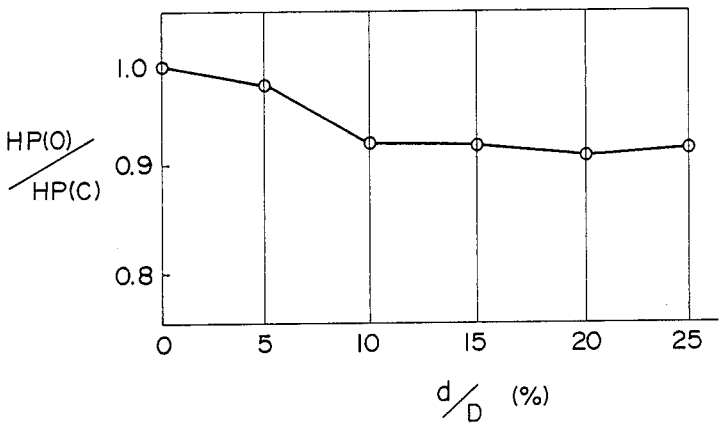
FIG. 8 is a graphic representation showing the relation of a distance between a propeller shaft and the vertical hull center plane to relative propulsive power ratio against a prior art vessel according to the present invention.

FIG. 8 graphically shows a relation of a distance between propeller shaft 3 and the vertical hull center plane 2 to relative propulsive power ratio efficiency which was obtained through a water tank test of propelling a 200,000 DWT ore carrier. In FIG. 8, the ordinate shows a ratio of HP(O)/HP(C) where HP(O) represents the propulsive horse power generated by an engine in the case of a propeller shaft positioned laterally offset from the vertical hull center plane and HP(C) represents the propulsive horse power generated in the case of a propeller shaft positioned on the vertical hull center plane, and the abscissa represents a ratio of d/D where d represents a distance between the propeller shaft and the vertical hull center plane and D represents a diameter of a propeller. As seen from FIG. 8, the relative propulsive power ratio shown by the HP(O)/HP(C) is remarkably improved when the d/D ranges from 5 to 25%. If the ratio is less than 5%, the propulsive efficiency does not increase. On the other hand, if the ratio is over 25%, the propulsive efficiency does not increase, either. The ratio range from 10 to 15% is most preferably.

Other test results proved that rudder position was not required to be restricted owing to this positioning of the propeller shaft; the rudder position was not unfavorably affected.

The present invention enabled the propulsive efficiency to be improved (by 10% approximately) by making use of vertical vortices which had caused a reduced propulsive efficiency in a conventional vessel with wide breadth and high blockage. Moreover, the present invention also enables keeping the hull structure symmetrical on both sides of the vessel.

What is claimed is:

1. A vessel having a single screw propulsion system, comprising:

a hull which is approximately symmetrical with respect to a vertical center plane containing the center line of the hull;

a propeller shaft positioned laterally offset from said vertical center line of the hull; and a propeller mounted on said propeller shaft for propelling the vessel, said propeller having a diameter D;

said propeller shaft being laterally offset by a distance d from said vertical center plane such that a ratio (d/D) is from 5 to 25%.

2. The vessel of claim 1, wherein said ratio (d/D) is from about 10 to about 25%.

3. The vessel of claim 1, wherein said ratio (d/D) is from about 15 to about 25%.

4. The vessel of claim 1, wherein said propeller shaft is positioned on the starboard side of said vertical center plane of said hull, and means is provided for rotating said propeller shaft in a clockwise direction.

5. The vessel of claim 1, wherein said propeller shaft is positioned on the port side of said vertical center plane of said hull, and means is provided for rotating said propeller shaft in a counterclockwise direction.

6. The vessel of claim 1, wherein said propeller shaft is arranged substantially horizontally and substantially parallel to said vertical center plane of said hull.

7. The vessel of claim 1, wherein said propeller shaft is arranged at an angle to said vertical center plane of said hull.

8. The vessel of claim 7, wherein said propeller shaft is arranged substantially horizontally.

* * * * *

UNITED STATES PATENT AND TRADEMARK OFFICE

CERTIFICATE OF CORRECTION

PATENT NO. : 4,779,551

DATED : October 25, 1988

INVENTOR(S) : MATSUMOTO

It is certified that error appears in the above-identified patent and that said Letters Patent is hereby corrected as shown below:

Column 1, line 34, "distribution" should be -- distributions--

Column 2, line 31, delete "plan"

Column 2, line 37, "place 2." should be -- plane 2. --

Column 3, line 9, delete "With reference now specifically to the drawing,"

Column 3, line 15, delete "the"

Column 3, line 19, "determined" should be -- determines --

Signed and Sealed this

Third Day of October, 1989

*Attest:*

*Attesting Officer*

DONALD J. QUIGG

*Commissioner of Patents and Trademarks*